United States Patent [19]

Rossi et al.

[11] Patent Number: 4,537,602

[45] Date of Patent: Aug. 27, 1985

[54] ADDITIVE CONCENTRATES FOR DISTILLATE FUELS

[75] Inventors: Albert Rossi, Warren, N.J.; Kenneth Lewtas, Wantage, England

[73] Assignee: Exxon Research & Engineering Co., Florham Park, N.J.

[21] Appl. No.: 532,319

[22] Filed: Sep. 15, 1983

[30] Foreign Application Priority Data

Sep. 16, 1982 [GB] United Kingdom ..... 82-26430

[51] Int. Cl.[3] ..... C10L 1/24

[52] U.S. Cl. ..... 44/62; 44/70; 44/71

[58] Field of Search ..... 44/71, 70, 62

[56] References Cited

U.S. PATENT DOCUMENTS

| | | | |
|---|---|---|---|
| 3,658,493 | 4/1972 | Hollyday, Jr. | 44/66 |
| 3,850,587 | 11/1974 | Frost, Jr. | 44/70 |
| 3,961,915 | 6/1976 | Wisotsky | 44/70 |
| 3,982,909 | 9/1976 | Hollyday, Jr. | 44/71 |
| 4,087,255 | 5/1978 | Wisotsky et al. | 44/70 |
| 4,210,424 | 7/1980 | Feldman et al. | 44/70 |
| 4,211,534 | 7/1980 | Feldman | 44/70 |
| 4,402,708 | 9/1983 | Oswald | 44/71 |

FOREIGN PATENT DOCUMENTS

| | | |
|---|---|---|
| 823015565 | 10/1982 | European Pat. Off. . |
| 823015573 | 10/1982 | European Pat. Off. . |
| 1010714 | 11/1965 | United Kingdom . |

*Primary Examiner*—Y. Harris-Smith

*Attorney, Agent, or Firm*—Frank T. Johmann

[57] ABSTRACT

An additive concentrate for incorporation into wax containing petroleum fuel oil compositions to improve low temperature flow properties comprising an oil solution containing:

(a) 3% to 90 wt. % of a $C_{30}$–$C_{300}$ oil-soluble nitrogen compound wax crystal growth inhibitor having at least one straight C8–C40 alkyl chain and partial esters, and (b) at least one mole per mole of (a) of an organic acid capable of hydrogen bonding with (a) to improve the solubility of (a) in the oil.

20 Claims, No Drawings

ADDITIVE CONCENTRATES FOR DISTILLATE FUELS

This invention relates to additives to improve the flow and filterability properties of distillate fuels at low temperatures, to fuels containing the additives and especially to concentrates of the additives for incorporation into the fuel.

Particularly, the invention relates to an additive concentrate composed of a nitrogen-containing wax crystal growth inhibitor of high active ingredient content which may be incorporated into distillate fuel to give improved flow.

Additive systems comprising nitrogen containing amide or amine salts as used in the present invention are disclosed in U.S. Pat. No. 4,211,534 issued July 8, 1980 to Feldman which discloses a three component combination additive flow improver consisting of an ethylene polymer or copolymer, a second polymer of an oil soluble ester and/or $C_3$ and higher olefin polymer and, as a third component, a nitrogen containing compound. This three component system is said to have advantages over combinations consisting of any two of the additive components for improving the cold flow properties of distillate fuels.

Our European patent application 82301556.5 discloses the use of such nitrogen containing compounds in combination with certain ethylene/vinyl acetate copolymers as distillate additives which may be supplied in the form of concentrates.

U.S. Pat. No. 3,982,909, issued Sept. 28, 1976 to Hollyday discloses an additive system comprising amides, diamides and ammonium salts alone or in combination with certain hydrocarbons such as microcrystalline waxes or petrolatums and/or an ethylene backbone polymeric pour depressant, the combination being useful as a flow improver for middle distillate fuels.

Whilst such nitrogen containing derivatives of aromatic or cycloaliphatic polycarboxylic acids are highly effective flow improving additives they usually have low solubilities and tend to crystallise out of concentrates at ambient temperatures rendering the concentrate difficult to use.

The present invention is based on the discovery that the fluidity of an additive concentrate consisting of an amine salt that is an alkyl ammonium or amide compound having a total of 30–200 preferably 50–150 carbon atoms derived from certain carboxylic acids or anhydrides optionally in combination with other additives may be improved by the incorporation of an organic acid.

The present invention therefore provides an additive concentrate for incorporation into wax containing petroleum fuel oil compositions to improve low temperature flow properties comprising an oil solution containing (a) In the range of 3% to 90% preferably 3% to 70 wt. % based on a total weight of the concentrate of a $C_{30}$–$C_{300}$ oil-soluble nitrogen compound wax crystal growth inhibitor having at least one straight $C_8$–$C_{40}$ alkyl chain and being selected from the class consisting of alkyl ammonium salts and/or amides of aromatic or cycloaliphatic polycarboxylic acids or anhydrides thereof or the amides/amine salts of partial esters (b) at least one mole per mole of (a) of an organic acid capable of hydrogen bonding with (a).

The flow improver concentrates of the present invention may be incorporated into a broad category of fuels especially distillate fuels boiling in the range of about 120° C. to about 500° C. (ASTM D1160), preferably those distillate fuels boiling in the range of about 150° C.–400° C. to improve their flow properties.

The use of such fuels is extensive and these fuels tend to contain longer chain n-paraffins and will generally have higher cloud points. Generally speaking, these fuels are more difficult to treat effectively with conventional flow improver additives. The most common petroleum distillate fuels are kerosene, jet fuels, diesel fuels and heating oils. Low temperature flow properties are most usually encountered with diesel fuels and with heating oils.

The concentrates will generally be included in the fuel to give an additive concentration in the fuel up to about 0.5 wt. %, excellent results are usually achieved with additive concentrations in range of 0.005 to 0.25 wt. % and preferred in the range of about 0.005 to 0.05 wt. % based upon the weight of distillate fuel.

The nitrogen containing wax crystal growth inhibitors used in the concentrates of present invention are generally those having a total of 30–300, preferably 50–150 carbon atoms and being those oil-soluble amine salts and amides formed by reacting at least 1 generally at least 2 molar portions of a hydrocarbyl substituted amine with 1 molar portion of the aromatic or cycloaliphatic polycarboxylic acid, e.g. 2 to 4 carboxyl groups preferably dicarboxylic acids, or their anhydrides or partial esters of dicarboxylic e.g. mono-esters of dicarboxylic acids.

The amines may be primary, secondary, tertiary or quaternary, but preferably are secondary. Tertiary and quaternary amines can only form amine salts. Examples of amines include tetradecyl amine, cocoamine, hydrogenated tallow amine and the like. Examples of secondary amines include cocomethyl amine, dioctadecyl amine, methyl-behenyl amine and the like. Amine mixtures are also suitable and many amines derived from natural materials are mixtures. The preferred amine is a secondary hydrogenated tallow amine of the formula $HNR_1R_2$ wherein $R_1$ and $R_2$ are alkyl groups derived from tallow fat composed of approximately 4% $C_{14}$, 31% $C_{16}$, and 59% $C_{18}$.

Examples of suitable carboxylic acids (and their anhydrides) include cyclohexane dicarboxylic acid, cyclohexene dicarboxylic acid, cyclopentane dicarboxylic acid, naphthalene dicarboxylic acid, and the like. Generally these acids will have about 5–13 carbon atoms in the cyclic moiety. Preferred acids useful in the present invention are benzene dicarboxylic acids such as phthalic acid, terephthalic acid, and isophthalic acid. Phthalic acid or its anhydride is the particularly preferred embodiment.

It is preferred that the nitrogen containing compound has at least one straight chain alkyl segment extending from the compound containing 8–40, preferably 14–24 carbon atoms. Preferably the nitrogen compound contains at least three alkyl chains each containing from 8 to 40 carbon atoms and preferably at least two of these chains are normal. Also at least one ammonium salt, amine salt or amide linkage is required to be present in the molecule. The particularly preferred compound is the amide-amine salt formed by reacting 1 molar portion of phthalic anhydride with 2 molar portions of di-hydrogenated tallow amine. Another preferred embodiment is the diamide formed by dehydrating this amide-amine salt.

Also suitable are the amide or amine salts of monoesters of the aforesaid dicarboxylic acids, the alkyl chain of the ester containing about 8 to 40 carbon atoms. But lower alkyl monoesters may also be suitable provided the nitrogen compound is an oil-soluble compound and has about 30–300, preferably 50–150 carbon atoms. An octadecyl ester of an amine salt of phthalic anhydride is an example of a preferred embodiment in this category.

The concentrates of the present invention contain from 3% to 90 wt. %, preferably 3 to 70 wt. % more, preferably from 20 to 70 wt. %, most preferably from 30% to 60 wt. % of the oil soluble nitrogen compound.

The concentrates supplied by the additive suppliers will generally contain from 10 to 70 wt. % of the oil soluble nitrogen compound. These concentrates may however be cut back by the user with further diluent such as the distillate fuel itself to contain less than 10 wt. % of the nitrogen compound and here, even with these more dilute solutions the nitrogen compound can come out of solution and the techniques of the present invention are useful.

Other additives may be present in the concentrate with the nitrogen containing compound. Examples of combinations with ethylene/vinyl acetate copolymers which are particularly useful distillate additives are described in our European Patent application No. 82 301556.5 and our invention is especially useful with concentrates of such combination of additives.

Although the optimum polymer properties will vary from one fuel to another where the concentrate contains an ethylene vinyl acetate copolymer we prefer that the copolymer contain from 10 to 40 wt. % more preferably 10 to 35 wt. %, most preferably from 10 to 20 wt. % vinyl acetate; and have a number average molecular weight ($M_n$) as measured by Vapour Phase Osmometry within the range of about 1,000 to 30,000, preferably 1500 to 7000 more preferably 1500 to 5500 most preferably of 2500 to 5500 and a degree of branching in the range of 1 to 20 preferably 2 to 12. The degree of branching is the number of methyl groups other than those of the vinyl acetate in the polymer molecule per 100 methylene groups as determined by proton nuclear magnetic resonance spectroscopy as for example using a Perkin-Elmer R-34 Spectrometer on 20% (W/W) solution in ortho dichlorobenzene at 100° C. operating at 220 MHz in the continuous wave mode.

Where such additive mixtures are used the relative proportions of the nitrogen containing compound and the ethylene vinyl acetate copolymer in the concentrate may be varied according to the fuel in which the additive is to be used to achieve the improvement in flow and filterability. We have found that, based on the total weight of additive, at least 25 wt. % preferably at least 50 wt. % of the nitrogen containing compound should be used and more preferably between 25 and 95 wt. %, preferably 50 to 95 wt. %, most preferably between 60 and 90 wt. %, especially between 60 and 80 wt. % the balance being the ethylene/vinyl acetate copolymer.

Other suitable co-additives are the polyoxyalkylene glycol esters which form the subject of our European Patent Application No. 82 301557.3.

The use of certain acids, especially aromatic acids to improve the compatibility of the amines of alkyl succinic acids and ethylene vinyl acetate copolymers in concentrate mixtures of the oil for incorporation into distillate fuels is described in U.S. Pat. No. 3850587. This is, however, clearly a different technique from that of the present invention in that the amine derivatives of the alkyl succinic acids described in U.S. Pat. No. 3850587 are said to have no effect on their own as additives for distillate fuels unlike the nitrogen compounds with which the present invention is concerned. Furthermore, according to U.S. Pat. No. 3850587 the function of the acid is to interact with the ethylene vinyl acetate copolymer whilst the present invention is equally effective in additive concentrates containing only the nitrogen compound.

The acids for use in the concentrates of the present invention are organic acids and whilst their method of operation is not fully understood it is believed that they improve the solubility of the nitrogen compound in the oil used as solvent for the concentrate by hydrogen bonding. The choice of the acid may depend upon the nature of the nitrogen compound and examples of suitable acids include carboxylic acids, aromatic carboxylic acids being especially useful, sulphonic acids such as alkaryl sulphonic acids and phenols. In particular we prefer so use aromatic organic acids, especially weak acids such as benzoic acid, alkyl phenols and alkaryl sulphonic acids.

The improvement in the solubility of the nitrogen compound is achieved if at least one mole of acid is present for each mole of the nitrogen compound. Quantities in excess of one mole may be used up to the level in which the acid becomes insoluble in the hydrocarbon solvent. The maximum amount of acid depends to some extent on the concentration of the nitrogen compound but with concentrates containing more than 20 wt. % of the nitrogen compound we prefer to use no more than 3 moles of the acid per mole of the nitrogen compound although at lower concentrations a higher ratio of acid may be used. We have also found that the storage stability of the additive concentrates depends upon the temperature at which it is stored and can be improved if the concentrate is heat soaked before storage. In particular we prefer to heat the concentrate to above 50° C., preferably around 60° C. for at least 10 hours before storage. The temperature used should not be so high as to decompose or otherwise adversely affect the oil soluble nitrogen compound.

The invention is illustrated by the following examples which are not to be considered as limitative of its scope.

Samples were prepared by stirring a mixture of the additive components, an organic compound and a 280 S.S.U. viscosity base oil at 60° C. for 1 hour. The additive components were 9 parts by weight of the amide/dialkyl ammonium salt from the reaction product of 1 mole of phthalic anhydride with 2 moles of a secondary dihydrogenated tallow amine containing a mixture of tallow fat n-alkyl groups as follows 4% $C_{14}$, 31% $C_{16}$ and 59% $C_{15}$ and 1 part by weight of an ethylene vinyl acetate copolymer or $\overline{M}n$ 3400 having 17.0 wt. % vinyl acetate and 8 methyl terminating alkyl side chains other than vinyl acetate per 100 methylene groups.

A series of 100 gram samples containing different organic compounds were made up in the laboratory and each sample was divided into three parts which were subsequently stored at ambient temperature for two weeks, and at 40° C. or 60° C. respectively for four weeks. Table 1 lists the organic compounds studied and reports on the status of each sample after storage.

TABLE 1

| Organic Compound Wt. % | wt. % Nitrogen Compound | Ambient Temp. | 40° C. | 60° C. |
|---|---|---|---|---|
| 5% Aniline | 30 | S | Se | C |
| 5% Phenol | 30 | S | Se | C |
| 10% Phenol | 30 | S | C | C |
| 10% Naphthenic Acid | 30 | S | Se | C |
| 10% Nonyl Phenol | 30 | S | Se | C |
| 10% Benzoic Acid | 40 | S | C | C |
| 10% Phenol | 30 | S | C | C |
| 15% Benzyl Alcohol | 40 | S | G | G |
| 10% Phenol | 40 | S | Se | C |
| 10% Benzyl Alcohol | 40 | S | Se | C |
| 10% Benzene Sulphonic Acid | 40 | S | Se | C |
| 10% p-Cresol | 40 | S | C | C |
| 10% Toluene Sulphonic Acid | 40 | S | Se | C |
| 10% Toluene Sulphonic Acid | 40 | S | H | C |
| 10% Benzene Sulphonic Acid | 40 | S | Se | C |

C = clear
S = solid
Se = sediment
H = haze
G = gel

EXAMPLE 2

The effect of heat soaking 100 gram samples of the concentrates and the storage temperature on samples containing varying amounts of the additive system used in Example 1 and benzoic acid were investigated and the condition of the samples after 14 days is given in the following Tables 2 to 5.

In these tables the letters have the following meaning:

| | | | |
|---|---|---|---|
| B = | Benzoic acid sedimentation | H = | Haze |
| S = | Solid | C = | Clear |
| Se = | Nitrogen Compound sedimentation | V = | Clear but very viscous solution |
| Op = | Opaque solution | | |

TABLE 2

Initially stood for 24 hours at 60° C. then at ambient temperature.

| | | Wt. % Benzoic Acid | | | | |
|---|---|---|---|---|---|---|
| | | 8 | 9 | 10 | 11 | 12 |
| wt. % Additive Mixture | 35 | C | C | C | C | B |
| | 40 | C | C | C | C | C |
| | 45 | C | C | C | C | C |
| | 50 | C | C | C | C | C |
| | 55 | S | Se | Se | Se | H |
| | 60 | | | | S | S |

TABLE 3

Initially stood for 48 hours at 60° C. then at ambient temperature.

| | | Wt. % Benzoic Acid | | | | |
|---|---|---|---|---|---|---|
| | | 8 | 9 | 10 | 11 | 12 |
| Wt. % Additive Mixture | 35 | C | C | C | C | B |
| | 40 | C | C | C | C | B |
| | 45 | C | C | C | C | C |
| | 50 | C | C | C | C | C |
| | 55 | Se | Se | C | | H |
| | 60 | | | | Op | S |

TABLE 4

Initially stood for 24 hours at 60° C. then 24 hours at 40° C., then at ambient temperature.

| | | Wt. % Benzoic Acid | | | | |
|---|---|---|---|---|---|---|
| | | 8 | 9 | 10 | 11 | 12 |
| Wt. % Additive Mixture | 35 | C | C | C | C | B |
| | 40 | C | C | C | C | B |
| | 45 | C | C | C | C | C |
| | 50 | Se | C | C | C | C |
| | 55 | Se | H | C | | H |
| | 60 | | | | S | S |

TABLE 5

Initially stood for 5 days at 60° C. then at ambient temperature.

| | | Wt. % Benzoic Acid | | | | |
|---|---|---|---|---|---|---|
| | | 8 | 9 | 10 | 11 | 12 |
| Wt. % Additive Mixture | 35 | C | C | C | C | B |
| | 40 | C | C | C | C | C |
| | 45 | C | C | C | C | C |
| | 50 | C | C | C | C | C |
| | 55 | S | C | C | V | V |
| | 60 | | | | H | S |

EXAMPLE 3

In this example the storage stability of 100 gram samples of concentrates containing 40 wt. % of a mixture of 4 parts of the oil soluble nitrogen compound used in Example 1 to 1 part of the ethylene-vinyl acetate copolymer used in Example 1 and varying amounts of benzoic acid was studied by first heating the samples at 60° C. for 24 hours and then inspecting the samples after standing for 2 weeks at ambient temperature. The results in terms of the ratio of the moles of Benzoic acid present to the number of moles of the nitrogen compound are plotted in Table 6 in which the letters have the following meanings.

C=Clear
H=Hazy
N=Precipitation of the Nitrogen Compound
B=Precipitation of Benzoic acid

TABLE 6

Moles of Nitrogen Compound ($\times 10^{-2}$)

| | | | | | | | |
|---|---|---|---|---|---|---|---|
| Moles of Benzoic Acid ($\times 10^{-2}$) | 10 | | B | B | B | | |
| | 9 | C | C | H | B | | |
| | 8 | | | | | | |
| | 7 | C | C | C | C | | |
| | 6 | | | | | | |
| | 5 | C | C | C | C | | |
| | 4 | | | | | | |
| | 3 | C | C | C | N | N | |
| | 2 | | | H | N | N | |
| | 1 | C | H | N | N | N | |
| | 0 | N | N | N | N | N | |
| | 0 | | 1 | 2 | 3 | 4 | 5 |

We claim:

1. An additive concentrate for incorporation into wax containing petroleum fuel oil compositions to improve low temperature flow properties of said oil comprising an oil solution containing (a) In the range of 3% to 90 wt. % based on a total weight of the concentrate of a $C_{30}$–$C_{300}$ oil-soluble nitrogen compound wax crystal growth inhibitor having at least one straight $C_8$–$C_{40}$ alkyl chain and being selected from the class consisting of ammonium salts, amine salts and amides of aromatic or cycloaliphatic dicarboxylic acids or anhydrides thereof having 5 to 13 carbon atoms in their cyclic moiety, and mono esters of said acids or anhydrides, said nitrogen compound being formed by reaction of about one to two moles of amine per mole of acid, anhydride or ester; and (b) one to three moles per mole of (a) of an organic acid capable of hydrogen bonding with (a) and improving the fluidity of said additive concentrate, selected from the group consisting of carboxylic acid, sulfonic acid and phenols.

2. An additive concentrate according to claim 1 in which the oil soluble nitrogen compound is obtained by the reaction of 1 mole phthalic anhydride with 2 moles of a secondary di(hydrogenated) tallow amine.

3. An additive concentrate according to claim 1 in which the organic acid is an aromatic carboxylic acid.

4. An additive concentrate according to claim 1 also containing an ethylene vinyl acetate copolymer.

5. An additive concentrate according to claim 4 in which the ethylene vinyl acetate copolymer contains from 10 to 40 wt. % ethylene and has a number average molecular weight from 1,000 to 30,000.

6. An additive concentrate according to claim 1 containing 10 to 70 wt. % of the oil soluble nitrogen compound.

7. An additive concentrate according to claim 4 containing from 50 to 95 wt. % of said oil soluble nitrogen compound based on the total weight of the oil soluble nitrogen compound and ethylene vinyl acetate copolymer.

8. A method of treating a distillate fuel oil by adding and mixing with a concentrate in an amount sufficient to add within the range of about 0.005 to 0.25 weight % of additive to said oil, said concentrate comprising an oil solution containing (a) In the range of 3% to 90 wt. % based on a total weight of the concentrate of a $C_{30}$–$C_{300}$ oil-soluble nitrogen compound wax crystal growth inhibitor having at least one straight $C_8$–$C_{40}$ alkyl chain and being selected from the class consisting of ammonium salts, amine salts and amides of aromatic or cycloaliphatic dicarboxylic acids or anhydrides thereof having 5 to 13 carbon atoms in their cyclic moiety, and mono esters of said acids or anhydrides, said nitrogen compound being formed by reaction of about one to two moles of amine per mole of acid, anhydride or ester; and (b) one to three moles per mole of (a) of an organic acid capable of hydrogen bonding with (a) and improving the fluidity of said additive concentrate, selected from the group consisting of carboxylic acid, sulfonic acid and phenols.

9. A method according to claim 8, wherein the oil soluble nitrogen compound is obtained by the reaction of 1 mole phthalic anhydride with 2 moles of a secondary dihydrogenated tallow amine.

10. A method according to claim 8, wherein the organic acid is an aromatic carboxylic acid.

11. A method according to claim 8, wherein said concentrate also contains an ethylene vinyl acetate copolymer.

12. A method according to claim 11, wherein said ethylene vinyl acetate copolymer contains from 10 to 40 wt. % ethylene and has a number average molecular weight from 1,000 to 30,000.

13. A method according to claim 8, wherein said additive concentrate contains 10 to 70 weight % of the oil soluble nitrogen compound.

14. A method according to claim 12, wherein said additive concentrate contains from 50 to 95 weight % of said oil soluble nitrogen compound based on the total weight of the oil soluble nitrogen compound and ethylene vinyl acetate copolymer.

15. A distillate fuel oil composition comprising a major proportion of distillate fuel and an additive concentrate in an amount sufficient to incorporate within the range of about 0.005 to 0.25 weight % of additive to said oil, said concentrate comprising an oil solution containing (a) In the range of 3% to 90 wt. %, based on a total weight of the concentrate, of a $C_{30}$–$C_{300}$ oil-soluble nitrogen compound wax crystal growth inhibitor having at least one straight $C_8$–$C_{40}$ alkyl chain and being selected from the class consisting of ammonium salts, amine salts and amides of aromatic or cycloaliphatic dicarboxylic acids or anhydrides thereof having 5 to 13 carbon atoms in their cyclic moiety, and mono esters of said acids or anhydrides, said nitrogen compound being formed by reaction of about one to two moles of amine per mole of acid, anhydride or ester; and (b) one to three moles per mole of (a) of an organic acid capable of hydrogen bonding with (a) and improving the fluidity of said additive concentrate, selected from the group consisting of carboxylic acid, sulfonic acid and phenols.

16. A distillate fuel oil composition according to claim 15 in which the oil soluble nitrogen compound is obtained by the reaction of 1 mole of phthalic anhydride with 2 moles of a secondary di(hydrogenated) tallow amine.

17. A distillate fuel oil composition according to claim 15 wherein said organic acid is an aromatic carboxylic acid.

18. A distillate fuel oil composition according to claim 15 wherein said additive concentrate also contains an ethylene vinyl acetate copolymer.

19. A distillate fuel oil composition according to claim 18 in which the ethylene vinyl acetate copolymer contains from 10 to 40 wt. % ethylene and has a number average molecular weight from 1,000 to 30,000.

20. A distillate fuel oil composition according to claim 15 containing 10 to 70 weight % of said oil soluble nitrogen compound.

* * * * *